US006225883B1

(12) United States Patent
Wellner et al.

(10) Patent No.: US 6,225,883 B1
(45) Date of Patent: May 1, 2001

(54) CIRCUIT BREAKER WITH LATCH AND TOGGLE MECHANISM OPERATING IN PERPENDICULAR PLANES

(75) Inventors: Edward Louis Wellner, Colgate; Paul Jason Rollmann, Milwaukee; Peter Klaus Moldovan, Cascade, all of WI (US); Thomas Michael Hall, Bradenton, FL (US); Steven Christopher Schmalz, Greenfield, WI (US); Michael Frederick Walz; James McCormick, both of Bradenton, FL (US); Engelbert Hetzmanseder, Milwaukee, WI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/504,421

(22) Filed: Feb. 15, 2000

(51) Int. Cl.[7] ..... H01H 9/00
(52) U.S. Cl. ..... 335/172; 335/167; 200/400
(58) Field of Search ..... 335/23–25, 18, 335/167–176; 200/400, 401

(56) References Cited

U.S. PATENT DOCUMENTS 3,758,887 * 9/1973 Ellsworth et al. ..... 335/8
3,792,403 * 2/1974 Bullock ..... 337/6
3,984,736 * 10/1976 Rai ..... 335/181
4,812,799 3/1989 Cobb, III et al. .
5,224,006 6/1993 MacKenzie et al. .
5,757,602 5/1998 Meili et al. .

* cited by examiner

*Primary Examiner*—Lincoln Donovan
*Assistant Examiner*—Tuyen Nguyen
(74) *Attorney, Agent, or Firm*—Marvin L. Union

(57) ABSTRACT

The toggle mechanism of a circuit breaker is connected at one end to the pivoted contact arm and at the other end to a pivoted latch lever which is engaged to latch the toggle mechanism by a latch member pivoted for movement in a plane perpendicular to the plane of the toggle mechanism. The latch member serves as an armature for a trip motor energized by a trip circuit responsive to an arc fault and/or a ground fault to unlatch the toggle mechanism and trip the circuit breaker open. The latch member is also tripped by a helical bimetal responsive to persistent overcurrents and coupled to the latch member through an ambient compensator bimetal cantilevered from the latch member. A flexible shunt connected between the helical bimetal and contact arm passes through an extension of the magnetic circuit of the trip motor to generate a magnetic field of sufficient strength to trip the latch member instantaneously in response to a short circuit.

18 Claims, 9 Drawing Sheets

CIRCUIT BREAKER WITH LATCH AND TOGGLE MECHANISM OPERATING IN PERPENDICULAR PLANES

Related Application: Commonly owned, concurrently filed application entitled "Circuit Breaker with Instantaneous Trip Provided by Main Conductor Routed Through Magnetic Circuit of Electronic Trip Motor" and identified by application Ser. No. 09/506,871.

BACKGROUND OF THE INVENTION

1. Field of the Invention

This invention relates to circuit breakers in which the toggle mechanism that opens and closes the breaker contacts and the latch which trips the toggle mechanism to automatically open the contacts operate in substantially perpendicular planes. Such an arrangement is particularly advantageous for subminiature circuit breakers, but can also be applied to larger breakers.

2. Background Information

One use of subminiature circuit breakers is in aircraft electrical systems where they not only provide overcurrent protection but also serve as switches for turning equipment on and off. As such, they are subjected to heavy use and therefore must be capable of performing reliably over many operating cycles. They also must be small to accommodate the high density layout of circuit breaker panels which make circuit breakers for numerous circuits accessible to a user. Subminiature circuit breakers can be used in an environment where they are subject to vibration. The circuit breaker must trip consistently within tolerance yet not be tripped out by vibration or shock loading.

Typically, subminiature circuit breakers have only provided protection against persistent overcurrents implemented by a latch triggered by a bimetal responsive to $I^2R$ heating resulting from the overcurrent. Some aircraft systems have also provided ground fault protection, but through the use of additional devices, namely current transformers which in some cases are remotely located from the protective relay. There is a growing interest in providing additional protection, and most importantly arc fault protection. Currently available subminiature circuit breakers do not respond to arc faults which are typically high impedance faults and can be intermittent. Nevertheless, such arc faults can result in a fire. Finally, there is an interest in providing an instantaneous trip in response to very high overcurrents such as would be drawn by a short circuit.

While larger circuit breakers, even the "miniature" circuit breakers used in residential applications provide multiple protection functions, the currently available subminiature circuit breakers do not have such combined features. Again, the challenge is to provide alternative protection in a very small package which will operate reliably with heavy use over a prolonged period. A device which meets all the above criteria and can be automatically assembled is desirable.

SUMMARY OF THE INVENTION

The present invention is directed to a circuit breaker with a structure which can be miniaturized yet provide multiple protection functions and operate reliably in an environment which can include vibration. The circuit breaker includes a toggle mechanism for opening and closing separable contacts which operates in one plane and a latch member which operates in a plane perpendicular to the operating plane of the toggle mechanism to unlatch the toggle mechanism and thereby automatically open the separable contacts. The latch is operated by an overcurrent assembly which provides response to $I^2R$ heating, very high overcurrents such as caused by short circuits, and other conditions such as an arc fault.

In particular, the circuit breaker includes a housing in which the separable contacts of a separable contact assembly are mounted. The toggle mechanism includes first and second pivotally connected toggle links moveable in a first plane and coupled to the contact assembly for opening and closing the separable contacts. A handle coupled to the toggle mechanism is used to manually open and close the separable contacts. The circuit breaker further includes a latch assembly latching the toggle mechanism in a latched condition in which it can be manually operated by a handle assembly between a toggle open and a toggle closed position to open and close the separable contacts. This latch member is moveable in a second plane perpendicular to the first plane to latch the toggle mechanism in the latched condition and to unlatch the toggle mechanism and trip the separable contacts open. An overcurrent assembly responsive to selected current conditions moves the latch member in the second plane to unlatch the toggle mechanism and thereby trip the separable contacts open.

The latch assembly also includes a latch lever pivotally mounted to move in the first plane. The latch member has a latch surface engaging the latch lever to latch the toggle mechanism in the latched condition. The separable contact assembly includes a fixed contact and a moveable contact carried by a pivotally mounted contact arm. The first end of the first toggle link is pivotally connected to the contact arm. The first end of the second toggle link is pivotally connected to the latch lever and a knee pin pivotally connects the second ends of the two toggle links. The handle assembly is connected to this knee pin for manually operating the toggle mechanism.

The overcurrent assembly includes a trip motor which pivots the latch member in the second plane out of the latch position to release the latch lever when the solenoid is energized. The trip motor is energized by a trip circuit which can respond for instance to arc faults. The latch member is magnetically permeable and forms an armature for the trip motor.

The overcurrent assembly also includes a helical bimetal which provides $I^2R$ heating protection. The free end of this helical bimetal is coupled in series with a cantilevered ambient temperature compensating bimetal which is secured to and pivots the latch member.

The housing comprises first and second molded insulative sections which join along a mating plane which is substantially parallel to the first plane in which the toggle links pivot. The separable contact assembly, the toggle mechanism, the latch member and the bimetals are all dropped into the first housing section. The trip motor is then inserted into the metal frame supporting these elements along with a trip circuit and is enclosed by the second section of the housing.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

The invention will be described as applied to a subminiature circuit breaker. These circuit breakers can be used in aircraft ac systems which are typically 400 Hz but can also be used in dc systems. It will also become evident that the invention is applicable to other circuit breakers including those used in ac systems operating at other frequencies, and to larger circuit breakers.

Figure 1:
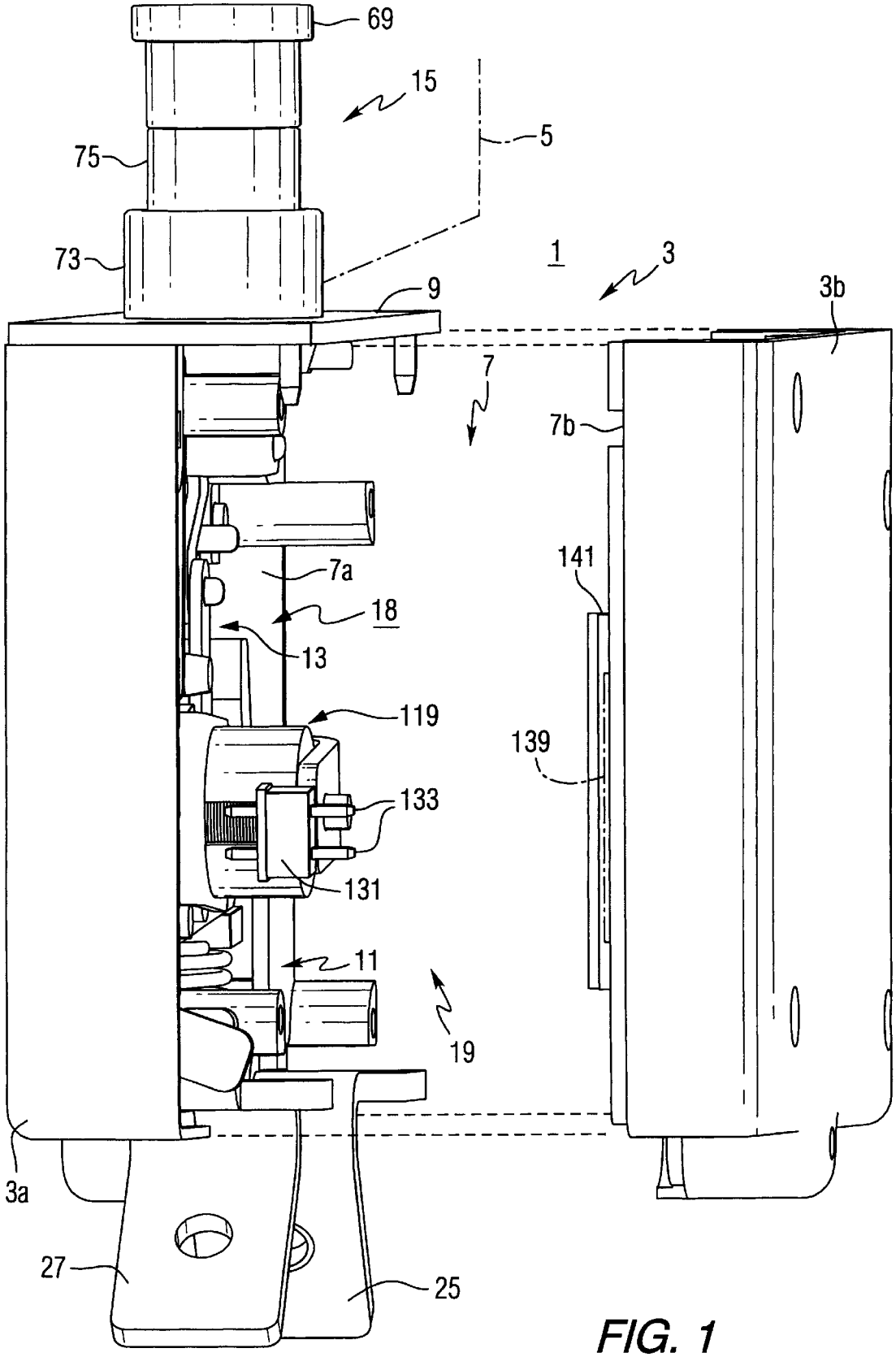
FIG. 1 is an isometric end view shown with the two molded sections of the housing separated.

Referring to FIG. 1, the circuit breaker 1 has a housing 3 formed by first and second sections 3*a* and 3*b* molded of an insulative resin which are joined along a mating plane 5 to form an enclosure 7 from confronting cavities 7*a* and 7*b*. The housing 3 of the exemplary circuit breaker has a metallic top wall 9 although alternatively this top wall can be part of the molded sections 3*a* and 3*b*.

Figure 2:
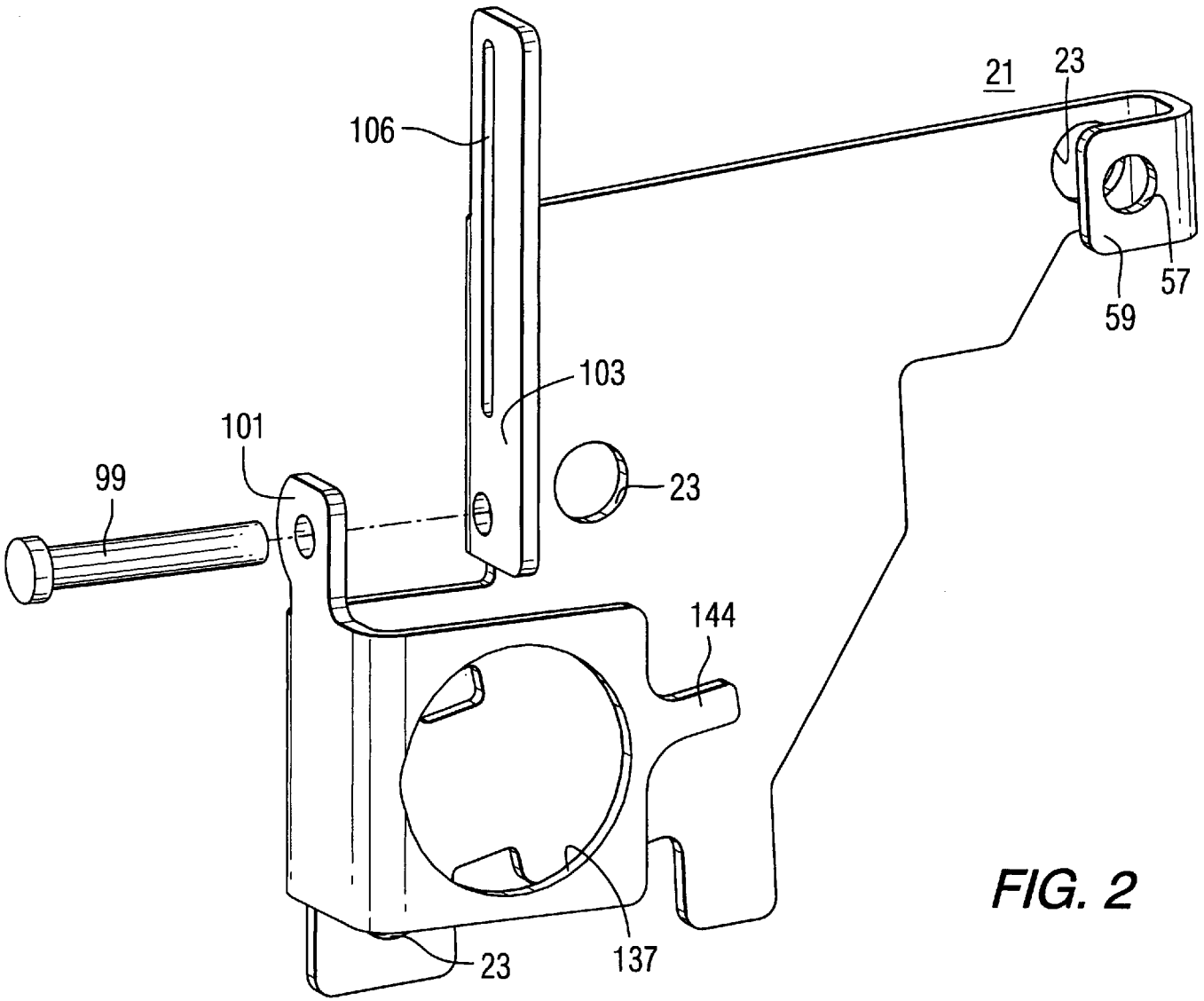
FIG. 2 is an isometric view of the circuit breaker support frame.

The functional components of the circuit breaker 1 include a separable contact assembly 11, a toggle mechanism 13, a handle assembly 15, a latch assembly 17, and an overcurrent assembly 19. The toggle mechanism 13 and latch assembly 17 together form a latchable operating mechanism 18. Turning momentarily to FIG. 2, a sheet metal frame 21, which as will be seen supports many of these functional components, is mounted in the cavity 7*a* in the molded section 3*a* by mounting holes 23 which engage molded pins in the housing section 3*a* as will be seen. The circuit breaker 1 also includes a line terminal 25 and load terminal 27 supported in the bottom of the molded housing and having cantilevered sections extending outside of the housing for connection to line and load conductors, respectively (not shown).

Figure 5:
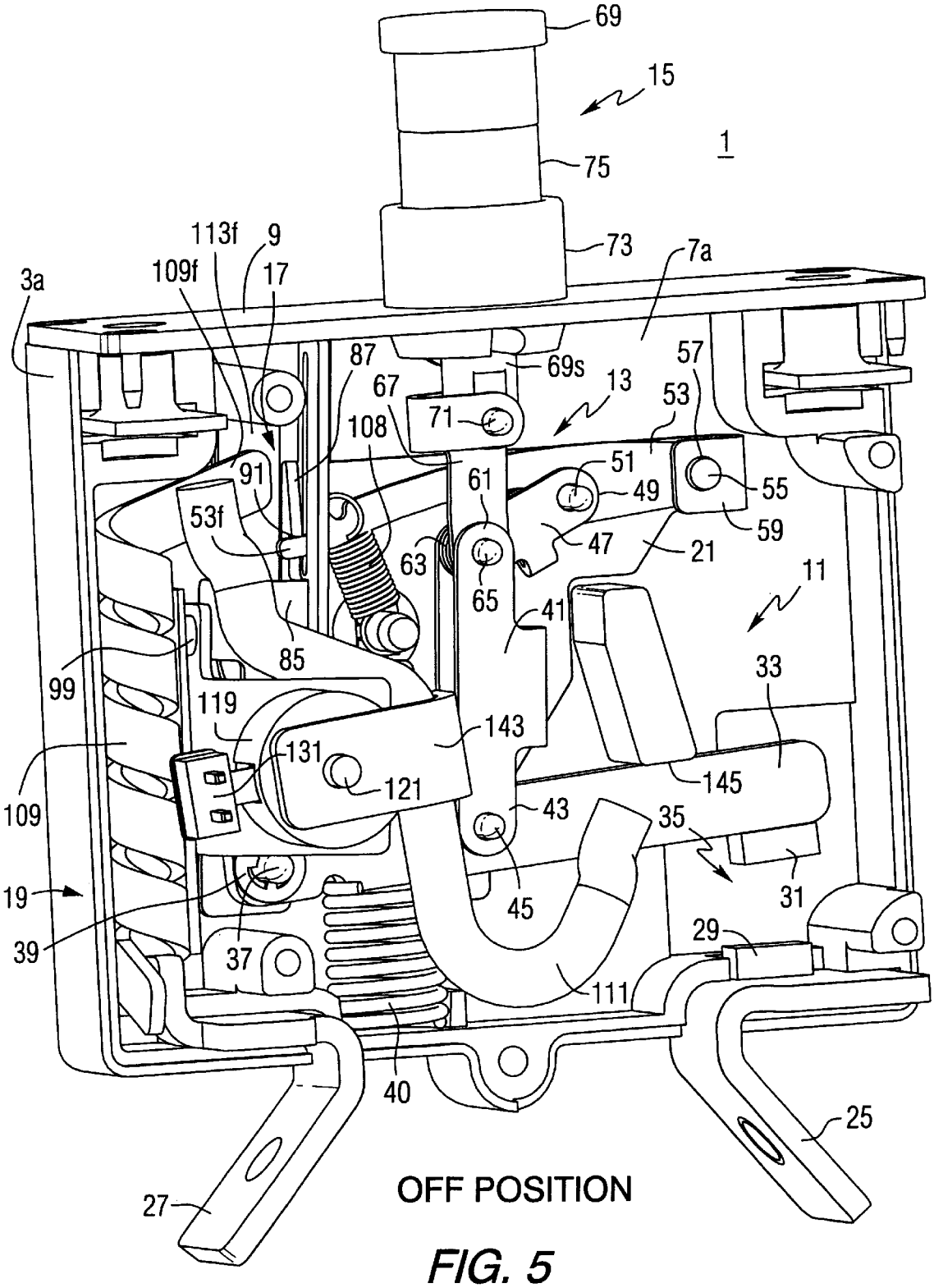
FIG. 5 is a front elevation view of the circuit breaker with one-half of the cover removed and showing the circuit breaker in the off condition.
Figure 6:
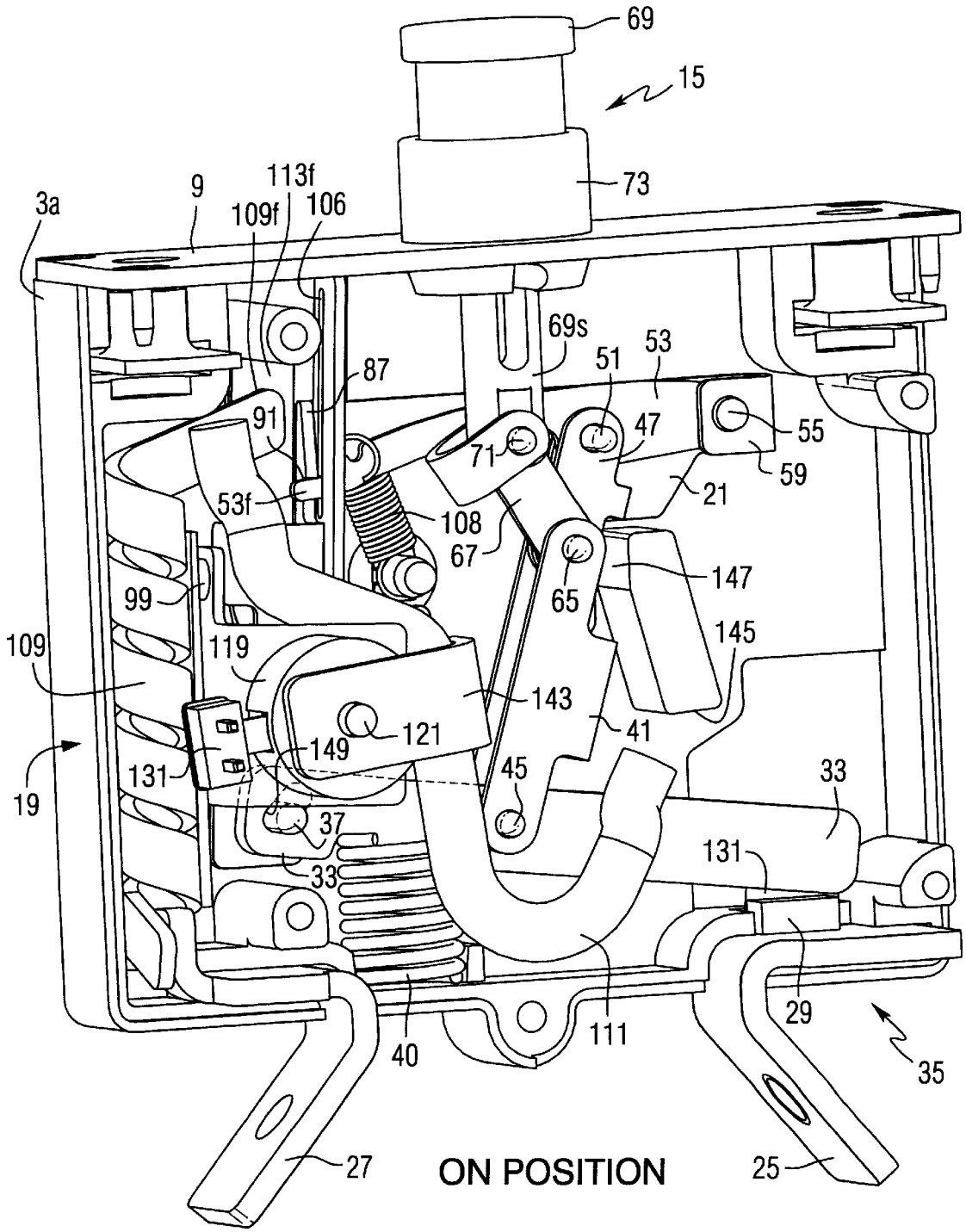
FIG. 6 is a view similar to FIG. 5 but showing the circuit breaker in the on condition.
Figure 7:
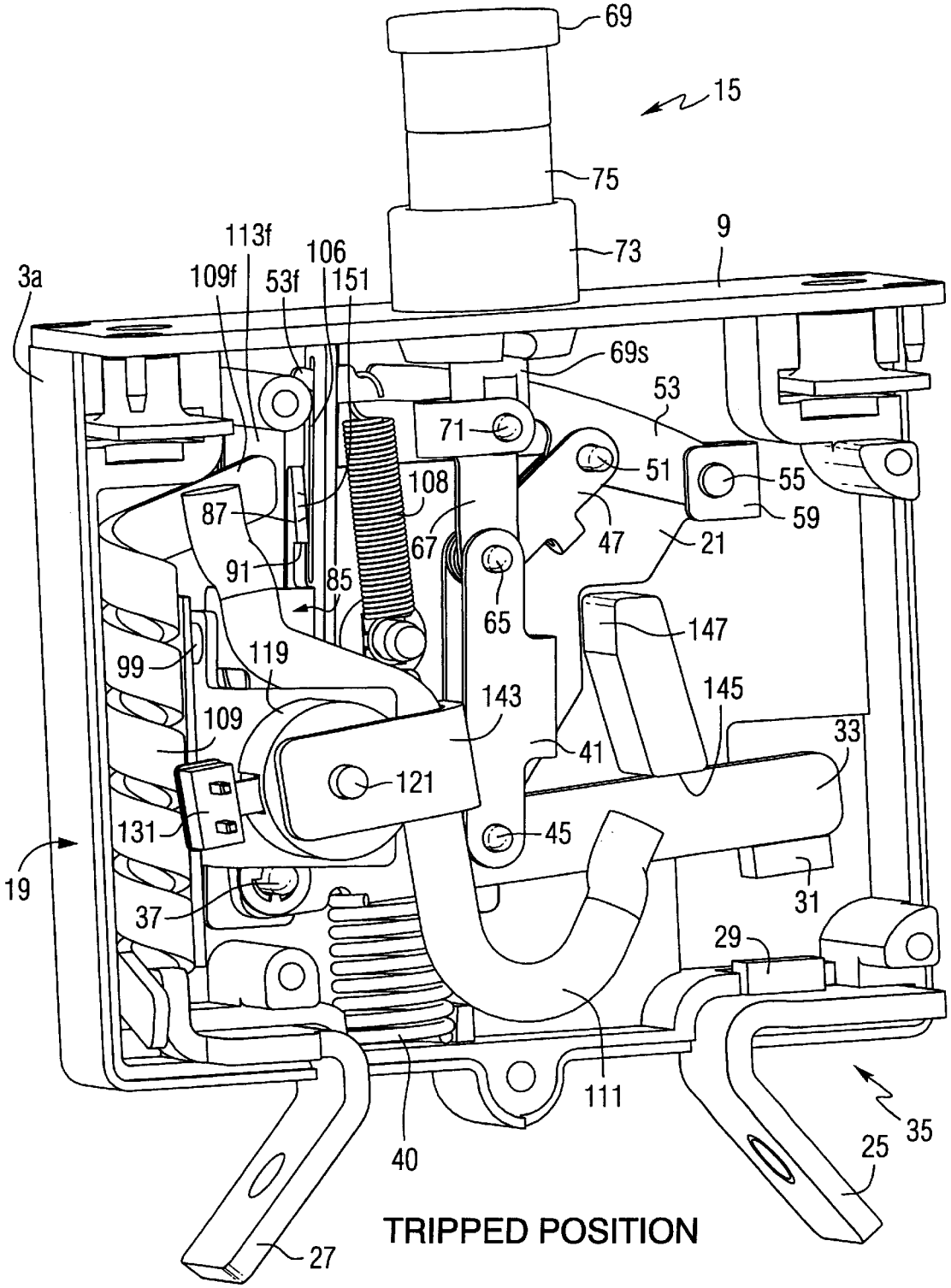
FIG. 7 is a view similar to FIG. 5 but showing the circuit breaker in the tripped condition.
Figure 9:
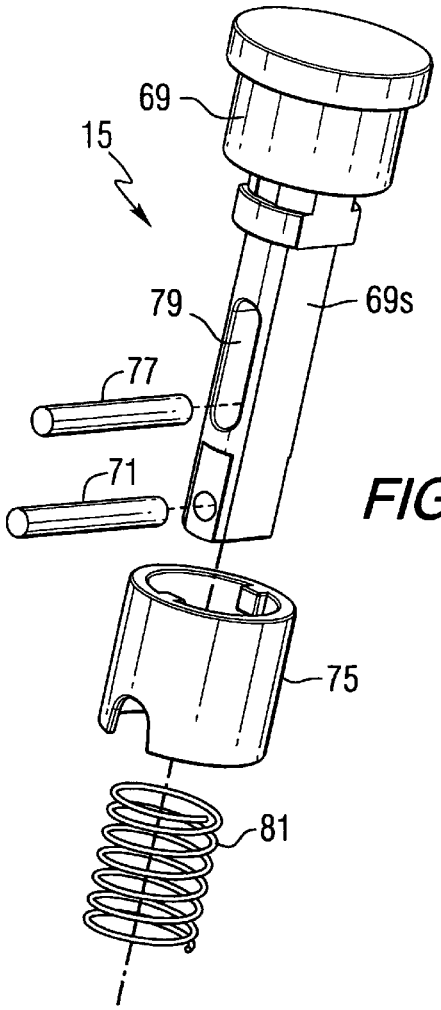
FIG. 9 is an exploded isometric view of parts of the handle assembly.

As best observed in FIGS. 5–7, the separable contact assembly 11 includes a fixed contact 29 fixed to the line terminal 25 and a moveable contact 31 carried by a contact arm 33. The fixed contact 29 and moveable contact 31 together form separable contacts 35. The contact arm 33 is pivotally mounted on a molded pin 37 which extends through one of the mounting holes 23 in the lower portion of the frame 21. A nut 39 retains the contact arm on the molded pin 37. A helical compression spring 40 forms a main spring which biases the contact arm counterclockwise as viewed in FIGS. 5–7 to open the separable contacts 35.

The contact arm 33 is pivoted between open and closed positions of the separable contacts 35 by the toggle mechanism 13. This toggle mechanism 13 includes a bifurcated first toggle link 41 pivotally connected at a first or lower end 43 to the contact arm 33 by a pin 45. A bifurcated second toggle link 47 is pivotally connected at a first end 49 by a pin 51 to a latch lever 53 which in turn is pivotally mounted by a molded pin 55 which extends through one of the mounting holes 23 in the frame 21 and into a hole 57 in a flange 59 on the frame 21. Second ends 61 and 63 of the first toggle link 41 and second toggle link 47, respectively, are pivotally connected by a knee pin 65. The toggle mechanism 13 further includes a drive link 67 which couples the toggle mechanism 13 to the handle assembly 15.

Figure 8:
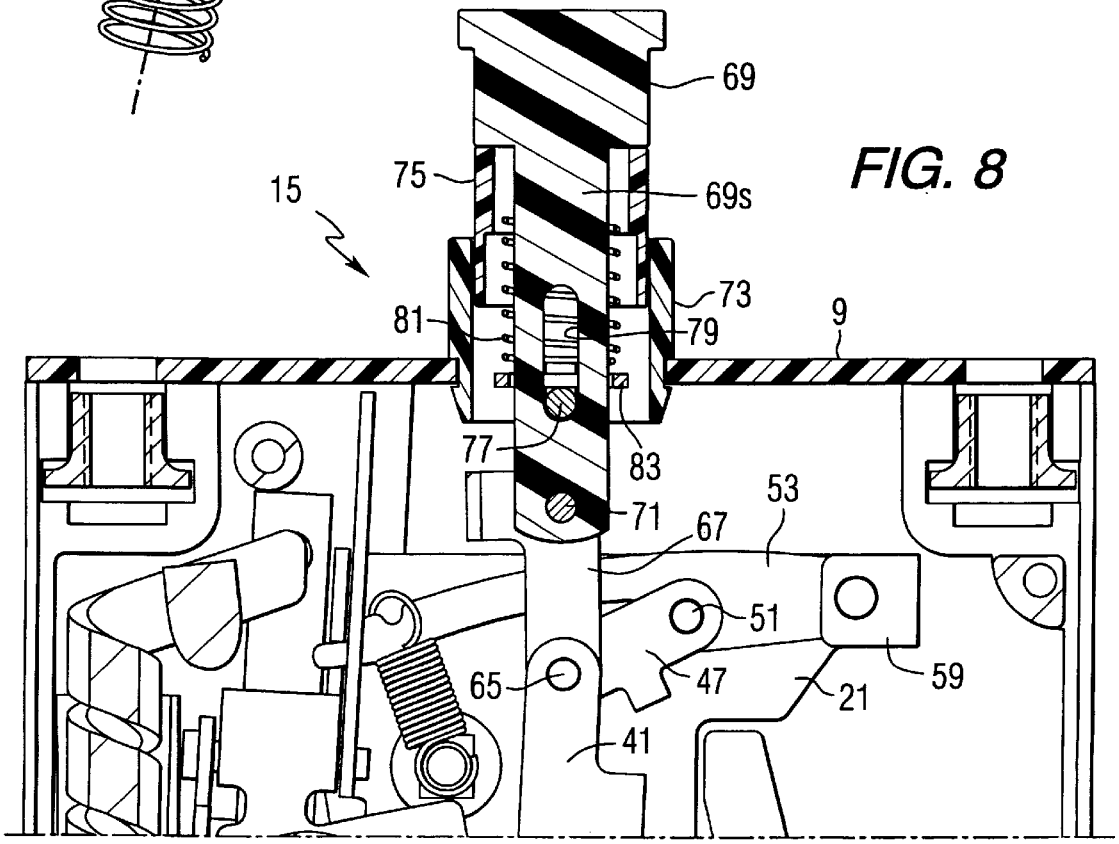
FIG. 8 is a fractional longitudinal section through the circuit breaker illustrating the handle assembly.

As can be seen from FIG. 8, the handle assembly 15 includes a handle member 69 having a stem 69s which is pivotally connected to the drive link 67 of the toggle mechanism 13 by a pin 71. The handle member 69 is supported for reciprocal linear movement by a bezel 73 seated in the end in the top wall 9 and an indicator sleeve 75. The handle member 69 is captured by a handle retention pin 77 extending transversely through the bezel 73 and a slot 79 in the handle stem 69*s*. A helical compression handle spring 81 on the handle stem 69*s* bears against a washer 83 which seats on the handle retention pin 77.

The latch assembly 17 includes in addition to the latch lever 53, a latch member 85. As can be observed in FIG. 8, the latch member 85 has a finger 87 terminating in a hook 89 which forms a latch surface 91. The latch member 85 has a flat armature section 93 with an upward extension 95 from which the latch finger 87 extends at right angles. A flange 97 also extends at right angles to the upward extension parallel to the contact finger 87. A latch pin 99 extends through the flange 97 and latch finger 87 to pivotally mount the latch member between first flange 101 and a second confronting flange 103 on the frame 21 (see FIG. 2). As can be seen from FIG. 3, the toggle links 41 and 47 pivot in a first plane 105 while the latch member 85 pivots in a second plane 107 which is substantially perpendicular to the first plane 105. As will be noticed, the contact arm 33, the latch lever 53 and the handle member 69 also move in the first plane. Additionally, it will be noted that the first plane 105 is substantially parallel to the mating plane 5 of the molded sections 3*a* and 3*b* of the housing.

Figure 3:
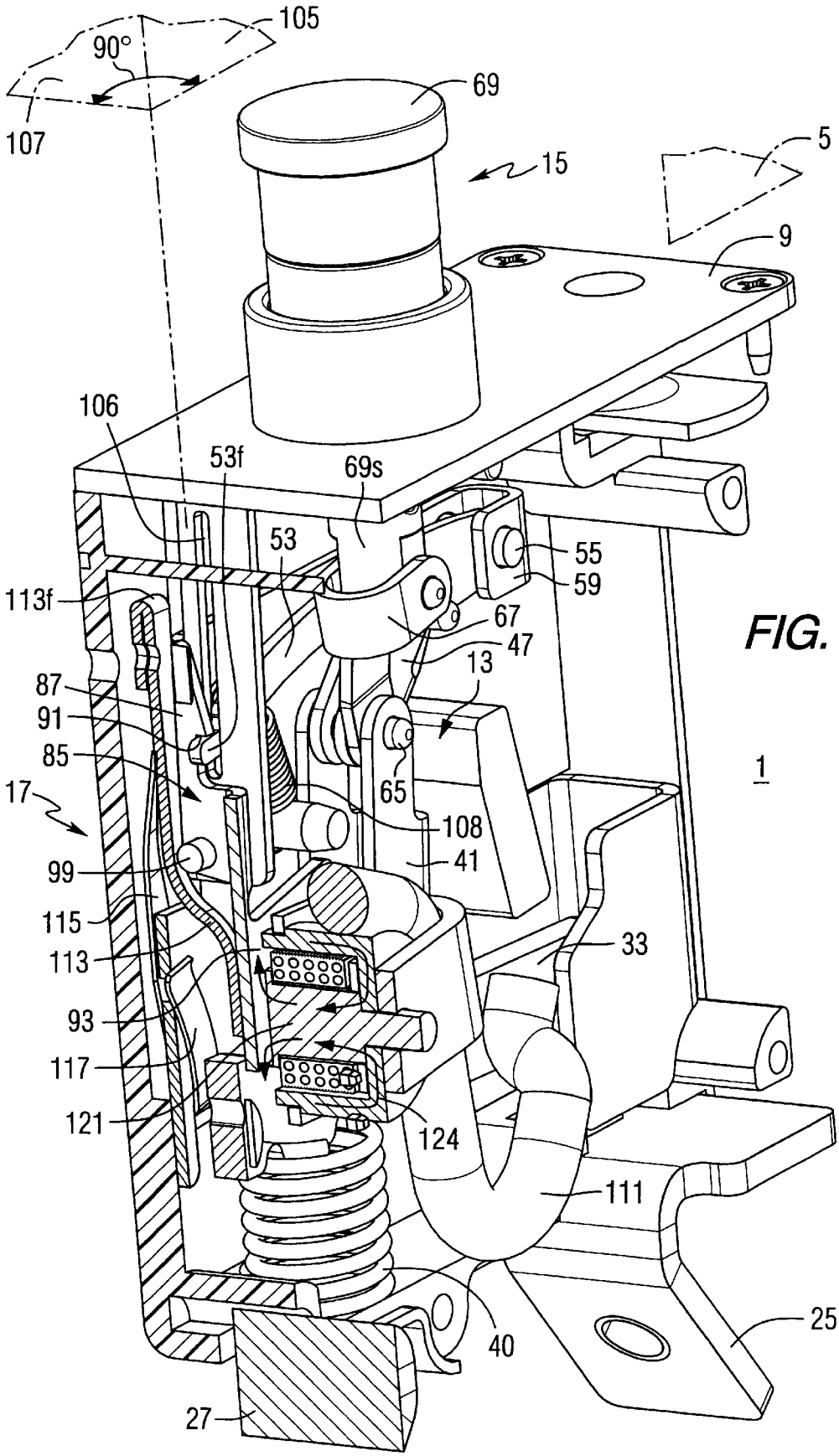
FIG. 3 is an isometric view from the front of the assembled latchable operating mechanism which forms part of the circuit breaker.

The latch surface 91 on the latch member 85 engages the free end 53*f* on the latch lever 53 which is guided in a slot 106 in the flange 103 on the frame 21 (see FIGS. 2 and 3). A latch lever spring 108 biases the latch lever 53 toward the latched position at the lower end of the slot 106.

The overcurrent assembly 19 includes a helical bimetal 109 which is fixed at one end to the load terminal 27. The free end 109*f* of the helical bimetal is connected by a main conductor in the form of a flexible shunt 111 to the contact arm 33. Thus, the load current which passes through the separable contacts 35 also passes through the helical bimetal 109. This causes $I^2R$ heating of the helical bimetal 109 resulting in unwinding of the free end 109*f*.

Figure 4:
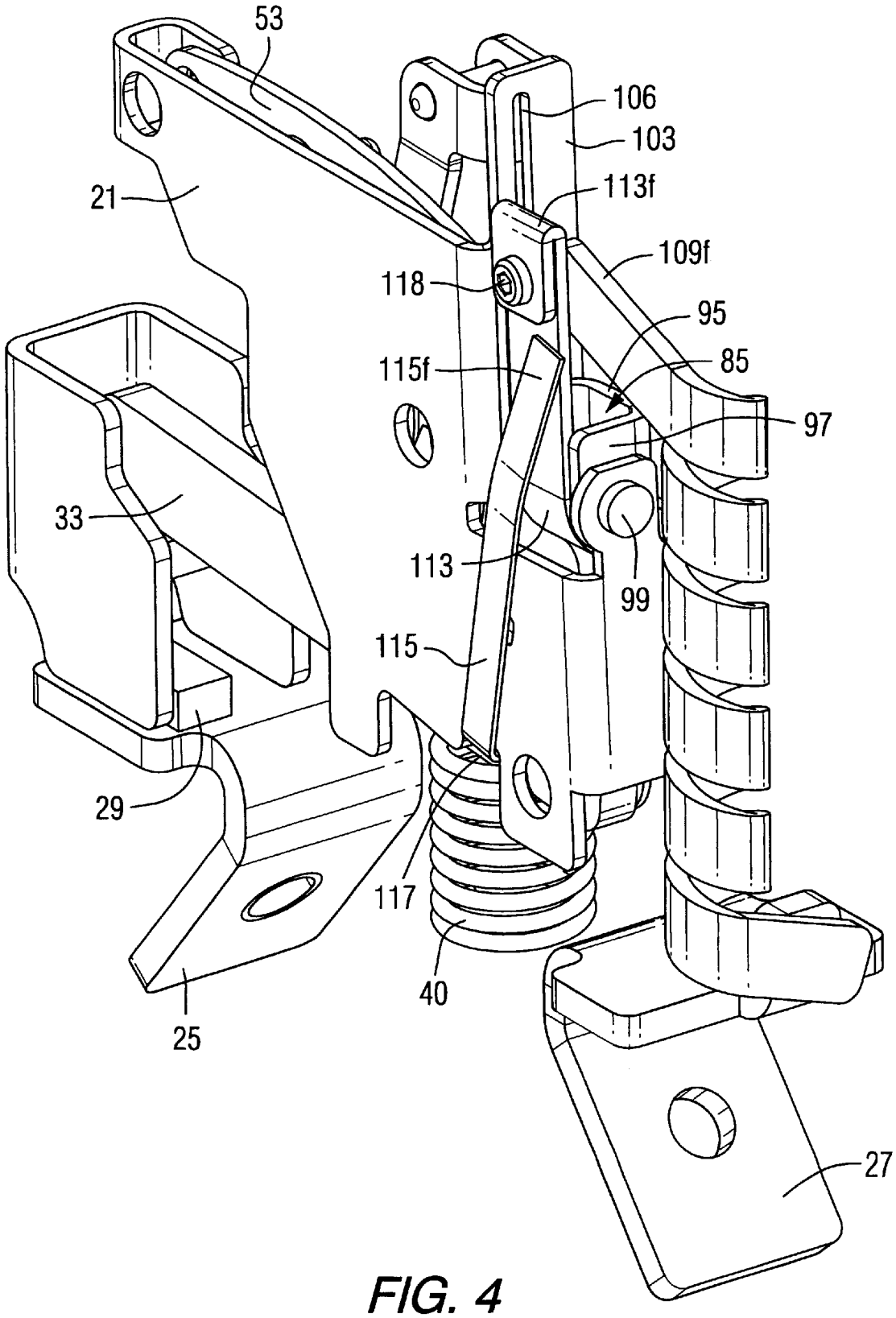
FIG. 4 is an isometric view from the rear of the assembly of FIG. 3.
Figure 10:
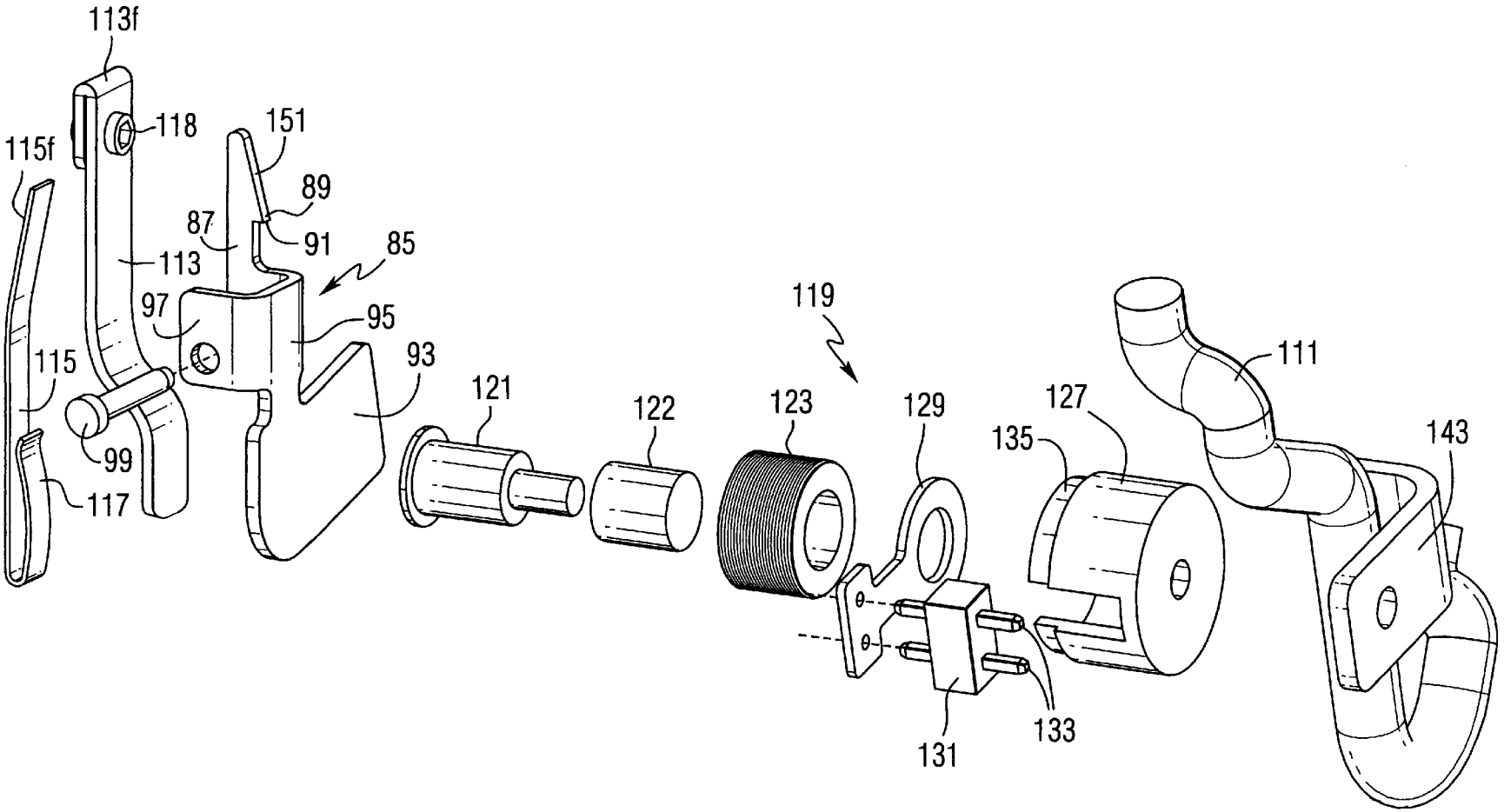
FIG. 10 is an exploded isometric view of the trip motor and latch which form part of the circuit breaker.

The overcurrent assembly 19 also includes a cantilevered ambient compensator bimetal 113. One end of this ambient compensator bimetal is fixed to the latch member at the armature section 93 such as by spot welding. This cantilevered ambient compensator bimetal 113 has an offset around the latch pin 99 (see FIG. 3) and extends upward to terminate in a free end 113*f* which is adjacent to the free end 109*f* of the helical bimetal 109 (see FIG. 4). A flat latch spring 115 is bent to form a clamp 117 (see FIG. 10) at the lower end which secures the flat latch spring to the frame 21 as shown in FIGS. 3 and 4. The free end 115*f* of this latch spring has a set which causes it to bear against the bimetal to bias the latch member 85 with the latch finger 87 forward. Under normal operating conditions there is a small gap between the free end 109 of the helical bimetal and the free end 115*f* of the ambient compensator bimetal.

The thermal trip can be calibrated by a calibration screw 118 which is threaded in the free end of one of the bimetals 109, 113 and projects towards the other. In the exemplary embodiment of the invention, this calibration screw 118 is seated in the free end 113*f* of the ambient compensator bimetal 113 as best seen in FIG. 4.

The overcurrent assembly 19 further includes a trip motor or solenoid 119. As shown in the exploded view of FIG. 10, this trip motor 119 includes a magnetically permeable motor core 121 which fits inside a coil sleeve 122 within the coil 123. This subassembly is housed in a magnetically permeable motor cup 127 which together with magnetically permeable core 121 form a magnetic circuit represented by the arrows 124 in FIG. 3. A pin holder 129 projects laterally outward through a slot in the motor cup and supports a connector 131 having pins 133 for the coil 121. The coil cup has a shoulder 135 which seats in an opening 137 in the frame 21 (see FIG. 2) with the motor core 121 facing the armature section 93 of the latch member 85. The trip motor 119 is energized through the electrical pins 133 by an electronic trip circuit 139 provided on a printed circuit board 141 shown in FIG. 1. This trip circuit 139 provides for instance arc fault protection. When the coil 123 is energized, the armature 93 of the latch member 85 is attracted toward the core 121 thereby rotating the contact finger 87 rearward to an unlatch position.

In order to provide an instantaneous trip, the overcurrent assembly 19 includes an arrangement for routing the main conductor formed by the flexible shunt 111 through the magnetic circuit 124 of trip motor 119 as shown in FIGS. 3, 5–7 and 10. For this purpose, the magnetic circuit is extended by a magnetically permeable bracket or pole piece 143 which at least partially surrounds the flexible shunt 111, so that magnetic flux generated by the current in the flexible shunt 111 flows through the bracket 143, the core 121 and magnetic cup 135, and the armature 93 of the latch member 85. Under short circuit conditions, the very high current circulating through the flexible shunt 111 generates a magnetic field which is coupled into the magnetic circuit 124 of the trip motor and attracts the latch member 85 to move the latch finger 87 to the unlatched position. The bracket 143 cooperates with a support finger 144 on the metal frame 21 (see FIG. 2) to secure the flexible shunt in place. The magnetic coupling is such that very high currents of at least a predetermined magnitude, such as those associated with short circuits, are sufficient to actuate the latch member 85 without energization of the coil 123 by the trip circuit 139.

The circuit breaker 1 operates in the following manner. In the off position shown in FIG. 5, the handle member 69 is up with the indicator sleeve 75 visible to indicate the off condition. The latch lever 53 is latched by engagement of its free end 53*a* by the latch surface 91 on the latch member 85. The knee pin 65 of the toggle mechanism 13 is to the left of an imaginary line between the pins 45 and 51. The main spring 40 has rotated the contact arm 33 counterclockwise against the molded stop 145 so that the separable contacts 35 are open. This is the toggle open position of the toggle mechanism 13.

The circuit breaker is turned on by depressing the handle member 69 which moves linearly downward to the position shown in FIG. 6. The drive link 67 pushes the knee pin 65 downward which results in clockwise rotation of the contact arm against the main spring 40 through the first toggle link 41. As the upper end of the second toggle link is held stationary by seating of the latch lever 53 against the bottom of the slot 106, the knee pin 65 translates counterclockwise until it passes through an imaginary line between the pins 45 and 51 at which point the main spring pressing up on the link 41 drives the knee pin 65 further counterclockwise until the toggle seats against the molded stop 147 in the toggle closed position shown in FIG. 6. This latter motion occurs through clockwise rotation of the contact arm 33 about the closed contacts 35 through the slotted aperture 149 by which the contact arm is pivotally mounted on the pin 37. With the contacts closed in this manner the main spring 40 provides contact pressure on the separable contacts 35 and accommodates for wear.

The circuit breaker 1 may be manually opened from the on position shown in FIG. 6 to the off position shown in FIG. 5 by raising the handle member 69. This translates the knee pin 65 counterclockwise through the drive link 67. Initially, a downward force is applied to the contact arm through the first toggle link 41, but when the knee pin passes through the center line between the pins 45 and 51, the toggle linkage breaks and the main spring 40 rotates the contact arm 33 counterclockwise until it seats against the molded stop 145 with the separable contacts 35 open. As the knee pin 65 translates clockwise the handle 69 rises to the off position shown in FIG. 5.

The circuit breaker 1 can be tripped to the open condition shown in FIG. 7 under several conditions. If a persistent overcurrent occurs, the free end 109*f* of the helical bimetal 109 rotates counterclockwise as viewed in FIG. 4 to engage the free end 113*f* of the ambient compensation bimetal and pushes it in the same direction to rotate the latch member 85 counterclockwise about the latch pin 99. This disengages the latch surface 91 to release the latch lever 53 which is driven clockwise about the molded pin 55 by the main spring which rotates the contact arm 33 counterclockwise to open the separable contacts 35 and through the toggle links 41 and 47. As this occurs, the handle spring 81 pulls the knee pin 65 through the center line between the pins 45 and 51.

The circuit breaker 1 is reset from the trip condition shown in FIG. 7 by the latch lever spring 108 which pulls the latch lever 53 counterclockwise with the help of the latch lever spring 108 until the free end 53*f* of the latch lever engages the cam surface 151 on the latch finger 87 to rotate the latch finger rearward. When the free end 53*f* of the latch lever 53 passes under the latch surface 91, the latch spring 115 rotates the latch member 85 back clockwise to latch the latch lever 53. Ambient temperature conditions cause the free end 109*f* of the helical bimetal and the free end 113*f* of the ambient compensator bimetal to move in the same direction and thereby maintain the appropriate gap between the two bimetal free ends to eliminate the effects of changes in ambient temperature.

For protection against arc faults, the electronic trip circuit 139 monitors the current for characteristics of such faults and energizes the coil 123 of the trip motor 119. The magnetic flux generated by the energization of the coil 123 attracts the armature section 93 of the latch member toward the motor core 121 to slide the latch surface 91 off of the tip 53*f* of the latch lever 53 thereby tripping the circuit breaker 1 open in the manner discussed above for a thermal trip.

In the event of a very high overcurrent of at least a predetermined magnitude such as could be associated with a short circuit, the flexible shunt 111 generates a magnetic field which is coupled into the bracket 143, the coil cup 135 and the trip motor core 121 to again attract the armature section 93 and rotate the latch member 85 to release the latch lever 53 and trip the circuit breaker in the manner described above.

The circuit breaker 1 is a simple reliable mechanism which selectively provides multiple protection functions as well as serving as an off/on switch. As the toggle mechanism 13 and the latch 85 operate in perpendicular planes, the circuit breaker 1 has enhanced immunity to vibrations which typically are confined to a single plane. This arrangement also lends itself to automated assembly. The molded section 3*a* of the housing 3 is placed on a flat surface and the parts are all inserted from above. The frame 21, the toggle mechanism 13, the handle assembly 15, the latch assembly 17 and the bimetals 109, 113 all fit into the cavity 7*a* in this section 3*a* of the housing 3. The trip motor 119 is seated in the opening 137 in the frame 21 and the printed circuit board 141 is connected to the electrical pins 133. The trip motor 119 and printed circuit board 141 which then project above the molded section 3*a*, extend into the enclosure portion 7*a* in the second molded section 3*b* which is placed over the section 3*a* and secured thereto by rivets (not shown).

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A circuit breaker comprising:

a housing;

a separable contact assembly including separable contacts;

a toggle mechanism having first and second pivotally connected toggle links moveable in a first plane and coupled to said separable contact assembly for opening and closing said separable contacts;

a handle assembly coupled to said toggle mechanism;

a latch assembly latching said toggle mechanism in a latched condition in which said toggle mechanism is manually operable by said handle assembly between a toggle open position and a toggle closed position to open and close said separable contacts, said latch assembly including a latch member moveable in a second plane substantially perpendicular to said first plane to latch said toggle mechanism in said latched condition; and an overcurrent assembly responsive to selected conditions of current flowing through said separable contacts for moving said latch member in said second plane to unlatch said toggle mechanism and trip said separable contacts open.

2. The circuit breaker of claim 1 wherein said latch assembly includes a latch lever pivotally mounted to move in said first plane, said latch member having a latch surface engaging said latch lever to latch said toggle mechanism in said latched condition.

3. The circuit breaker of claim 2 wherein said separable contacts comprise a fixed contact and a moveable contact and said separable contact assembly further comprises a main spring and a pivotally mounted contact arm carrying said moveable contact, a first end of said first toggle link being pivoted to said contact arm, a first end of said second toggle link being pivoted to said latch lever, and said toggle mechanism further including a knee pin pivotally connecting second ends of said first toggle link and of said second toggle link, said handle assembly being connected to said knee pin for pivoting said first toggle link and said second toggle link in said first plane between said toggle closed position in which said separable contacts are closed through a center position to said open toggle position in which said separable contacts are open through rotation of said contact arm by said main spring, said latch lever being rotated in said first plane to an unlatched position by said main spring upon unlatching of said latch lever by movement of said latch member in said second plane by said overcurrent assembly, said toggle links being pivoted to said toggle open position with said toggle lever in said unlatched position.

4. The circuit breaker of claim 3 wherein said handle assembly comprises a handle member, a handle mount mounting said handle member for rectilinear movement, and a drive link coupling said handle member to said knee pin for manually moving said first toggle link and second toggle link between said toggle close position and toggle open position.

5. The circuit breaker of claim 4 wherein said latch assembly further comprises a latch pin mounting said latch member for pivotal movement in said second plane, and a latch spring biasing said latch member to a latch position in which said latch surface can engage said latch lever.

6. The circuit breaker of claim 5 wherein said overcurrent assembly comprises a trip motor mounted adjacent said latch member for pivoting said latch member out of said latch position to release said latch lever when said trip motor is energized, and a trip circuit responsive to selected conditions of current flowing through said separable contacts for energizing said trip motor.

7. The circuit breaker of claim 6 wherein said latch member forms an armature for said trip motor and is magnetically pivoted by energization of said trip motor to unlatch said latch lever.

8. The circuit breaker of claim 7 wherein said housing comprises a first molded section and a second molded section joined along a mating plane which is substantially parallel to said first plane, said separable contact assembly, said toggle mechanism, said handle assembly, said latch assembly, and said overcurrent assembly being insertable into said first molded section generally in a direction parallel to said second plane and being enclosed by said second molded section.

9. The circuit breaker of claim 8 wherein said housing further comprises a metal frame in which said contact arm, toggle mechanism and latch lever are pivoted for movement in said first plane, and in which said latch member is pivotally mounted for rotation in said second plane.

10. The circuit breaker of claim 9 wherein said frame comprises a planar member with first and second spaced apart flanges supporting said latch pin on which said latch member is pivotally mounted.

11. The circuit breaker of claim 10 wherein said second flange has an elongated slot extending in said first plane and through which said latch lever extends and is guided for pivotal movement in said first plane.

12. The circuit breaker of claim 5 wherein said overcurrent assembly further comprises a helical bimetal which is heated by current flowing through said separable contacts and has a free end which is deflected by such heating, and a cantilevered ambient compensation bimetal, said helical bimetal and said cantilevered ambient compensator bimetal being coupled in series to said latch member to move said latch member out of said latch position to unlatch said toggle mechanism in response to a persistent overcurrent condition compensated for ambient conditions.

13. The circuit breaker of claim 12 wherein said cantilevered ambient compensator bimetal is secured to said latch member with its said free end adjacent said free end of said helical bimetal, said free end of said helical bimetal engaging said free end of said cantilevered ambient compensator bimetal to pivot said cantilevered ambient compensator bimetal and therefore said latch member in response to said predetermined persistent overcurrent condition.

14. The circuit breaker of claim 13 wherein said overcurrent assembly further includes a calibration screw threaded into one of said free end of said helical bimetal and said free end of said cantilevered ambient compensator bimetal and extending toward the other of said free end of said helical bimetal and said free end of said cantilevered ambient compensator bimetal.

15. The circuit breaker of claim 1 wherein said overcurrent assembly comprises a trip motor which when energized moves said latch member in said second plane to unlatch said toggle mechanism.

16. The circuit breaker of claim 15 wherein said latch member is magnetically permeable and forms an armature for said trip motor.

17. The circuit breaker of claim 1 wherein said overcurrent assembly comprises a helical current carrying bimetal and a cantilevered ambient compensator bimetal secured to said latch member, said helical bimetal and said cantilevered ambient compensator bimetal having free ends relatively positioned to move said latch member to unlatch said toggle mechanism in response to a persistent overcurrent condition which causes said free end of said helical bimetal to deflect said free end of said cantilevered ambient compensator bimetal.

18. The circuit breaker of claim 1 wherein said housing comprises a first molded section and a second molded section joined together along a mating plane which is substantially parallel to said first plane.

* * * * *